US007857661B1

(12) United States Patent
Islam

(10) Patent No.: US 7,857,661 B1
(45) Date of Patent: Dec. 28, 2010

(54) COAXIAL CABLE CONNECTOR HAVING JACKET GRIPPING FERRULE AND ASSOCIATED METHODS

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/706,162

(22) Filed: Feb. 16, 2010

(51) Int. Cl.
*H01R 9/05* (2006.01)

(52) U.S. Cl. ..... 439/584

(58) Field of Classification Search ..... 439/584, 439/579–585; 174/89
See application file for complete search history.

(56) References Cited

U.S. PATENT DOCUMENTS

| | | | | |
|---|---|---|---|---|
| 7,011,546 | B2 * | 3/2006 | Vaccaro | 439/580 |
| 7,288,002 | B2 | 10/2007 | Rodrigues et al. | 439/578 |
| 7,309,255 | B2 | 12/2007 | Rodrigues | 439/578 |
| 7,335,059 | B2 * | 2/2008 | Vaccaro | 439/578 |
| 7,473,128 | B2 | 1/2009 | Montena | 439/584 |
| 7,588,460 | B2 | 9/2009 | Malloy et al. | 439/578 |
| 7,731,529 | B1 * | 6/2010 | Islam | 439/583 |
| 2007/0212937 | A1 * | 9/2007 | Vaccaro | 439/578 |
| 2010/0130060 | A1 * | 5/2010 | Islam | 439/584 |

* cited by examiner

*Primary Examiner*—Chandrika Prasad
(74) *Attorney, Agent, or Firm*—Allen, Dyer, Doppelt, Milbrath & Gilchrist, P.A.

(57) ABSTRACT

A connector is to be attached to a coaxial cable having an inner conductor, an outer conductor, a dielectric between the inner conductor and outer conductor, and a jacket surrounding the outer conductor. The connector includes a back nut to be received over the jacket of the coaxial cable and having an internal back nut ramp defined therein. A connector housing engages the back nut. There is a jacket gripping ferrule within the back nut that has a rearward portion configured to be urged radially inwardly by the internal back nut ramp to thereby dig into the cable jacket as the connector housing and back nut are engaged.

27 Claims, 3 Drawing Sheets

COAXIAL CABLE CONNECTOR HAVING JACKET GRIPPING FERRULE AND ASSOCIATED METHODS

FIELD OF THE INVENTION

The present invention relates to the field of connectors for cables, and, more particularly, to connectors for coaxial cables and related methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter coaxial cable extending between the equipment shelter and the top of the antenna tower to thereby reduce signal losses. Some coaxial cables include a smooth outer conductor while other coaxial cables instead have a corrugated outer conductor. These coaxial cables also have an inner conductor and a dielectric between the outer conductor and the inner conductor. Some inner conductors are hollow, while other inner conductors are formed around an inner conductor dielectric core.

A typical connector for such a coaxial cable includes a connector housing to make an electrical connection to the outer conductor and a center contact to make electrical connection to the inner conductor of the coaxial cable. Such a connector may also include a back nut that is positioned onto the end of the outer conductor and adjacent the outer insulating jacket of the coaxial cable.

It is desirable for the connector to be securely affixed to the coaxial cable. Movement of the connector about the coaxial cable can lead to an undesired amount of intermodulation distortion, for example. Therefore, attempts have been made at designing connectors that securely attach to coaxial cables.

U.S. Pat. No. 7,011,546 to Vaccaro discloses a connector for a coaxial cable having a smooth outer conductor. The connector includes a connector housing, a back nut threadingly engaging a rearward end of the connector housing, a ferrule gripping and advancing an end of the coaxial cable into the connector housing as the back nut is tightened, and an insulator member positioned within a medial portion of the connector housing. The insulator member has a bore extending therethrough and includes a forward disk portion, a rearward disk portion, a ring portion connecting the forward and disk portions together, and a tubular outer conductor support portion extending rearwardly from the rearward disk portion for supporting an interior surface of the outer conductor of the coaxial cable.

A ferrule to receive the cable jacket therethrough is positioned in the back nut. The ferrule includes a supporting band portion and a plurality of circumferentially spaced apart gripping members carried by the support band portion. The gripping members include inner tabs that dig into the jacket, helping to reduce or eliminate axial movement of the connector with respect to the coaxial cable.

Despite these developments in connector technology, a need remains for connectors that may facilitate easy installation and that remain securely attached to the coaxial cable under a variety of operating conditions.

SUMMARY OF THE INVENTION

In view of the foregoing background, it is therefore an object of the present invention to provide an easy to install connector for a coaxial cable that remains securely affixed to the coaxial cable under a variety of operating conditions.

This and other objects, features, and advantages in accordance with the present invention are provided by a connector to be attached to a coaxial cable comprising an inner conductor, an outer conductor, a dielectric between the inner conductor and outer conductor, and a jacket surrounding the outer conductor. The connector may comprise a back nut to be received over the jacket of the coaxial cable and having an internal back nut ramp defined therein. In addition, a connector housing may engage the back nut. Further, there may be a jacket gripping ferrule within the back nut and comprising a rearward portion configured to be urged radially inwardly by the internal back nut ramp to thereby dig into the cable jacket as the connector housing and back nut are engaged.

The connector housing may have a connector housing ramp defined therein, and the jacket gripping ferrule may have a forward portion coupled to the rearward portion. A ring may clamp against the outer conductor opposite the connector housing ramp and may engage the forward portion of the jacket gripping ferrule as the connector housing and the back nut are engaged. In some applications, the ring may comprise an electrically conductive coil spring.

The forward portion of the jacket gripping ferrule may have an end extending radially outwardly to be engaged by the ring. The end of the forward portion may be angled rearwardly. In some instances, the forward portion and rearward portion of the jacket gripping ferrule may be parallel before the connector housing and the back nut are fully engaged. In addition, the jacket gripping ferrule may have an intermediate offset defining portion between the forward portion and the rearward potion. The back nut may have an internal shoulder defined therein, and the intermediate offset defining portion of the jacket gripping ferrule may be received against the shoulder.

The jacket gripping ferrule may comprise a base ring and a plurality of tapered teeth carried thereby. At least one dielectric body may be carried within the housing, and a center contact may be carried by the at least one dielectric body for coupling to the inner conductor of the coaxial cable.

A method embodiment is directed to a method of making a connector 20 to be attached to a coaxial cable 45 comprising an inner conductor 49, an outer conductor 47, a dielectric 48 between the inner conductor and outer conductor, and a jacket 46 surrounding the outer conductor. The method includes forming a back nut 40 to be received over the jacket 46 of the coaxial cable 45 and having an internal back nut ramp 41 defined therein. The method also includes forming a connector housing 21 to engage the back nut 40. A jacket gripping ferrule 31 is formed to be positioned within the back nut 40 and has a rearward portion 33 configured to be urged radially inwardly by the internal back nut ramp 41 to thereby dig into the cable jacket 46 as the connector housing 21 and back nut are engaged.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
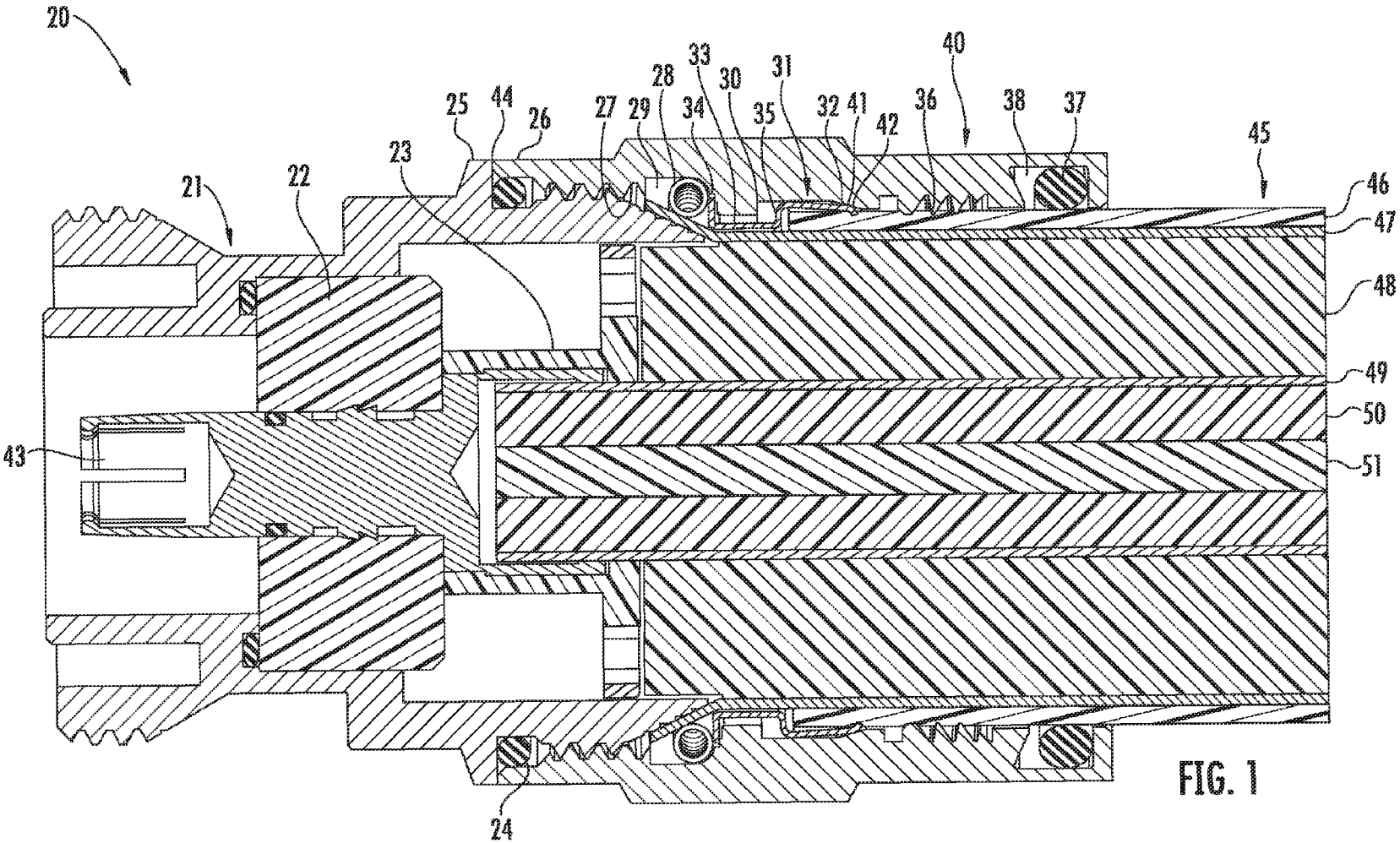
FIG. 1 is a longitudinal cross-sectional view of a connector installed on the end of a coaxial cable having a smooth outer conductor in accordance with the present invention.
Figure 2:
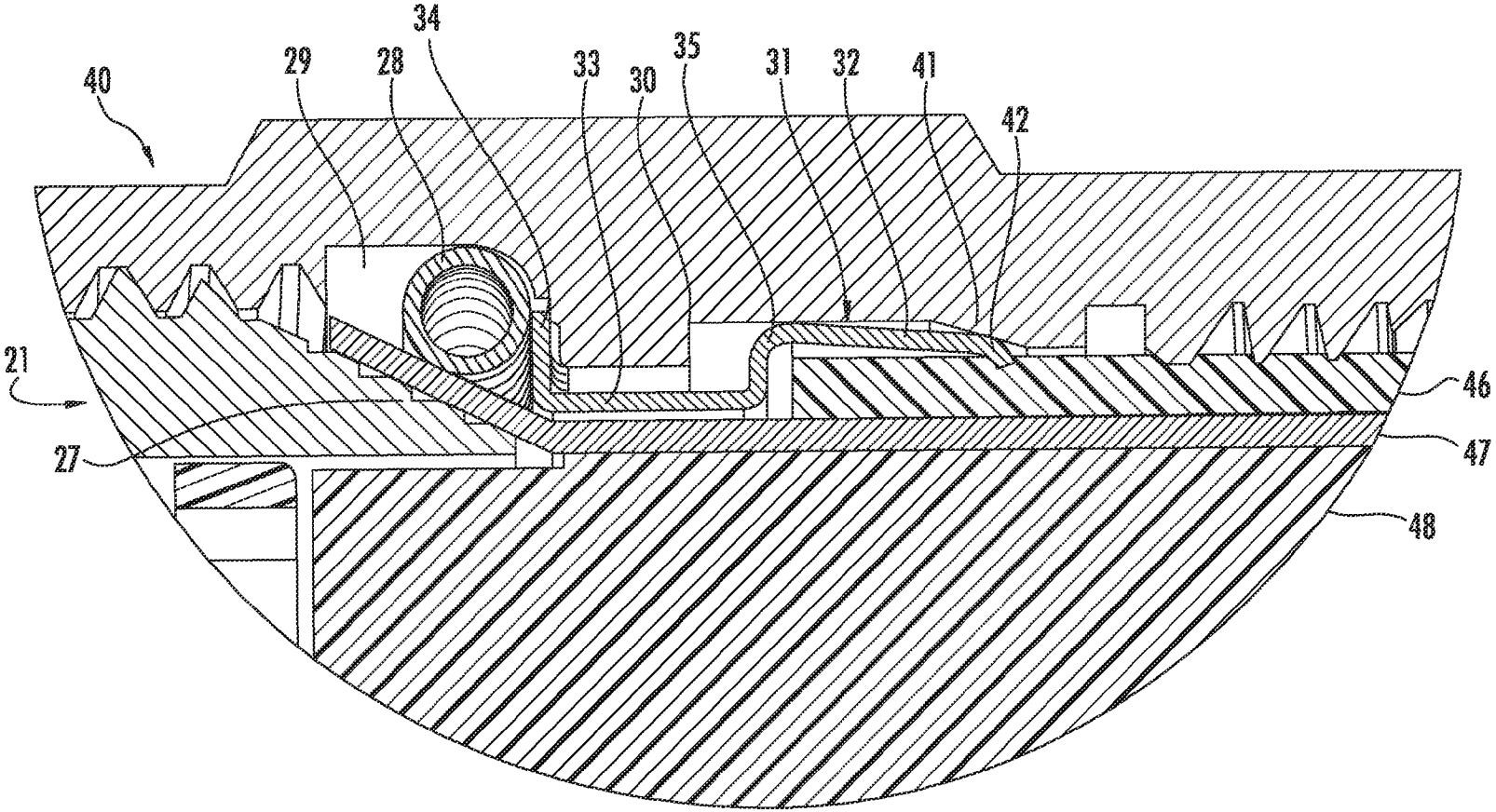
FIG. 2 is a greatly enlarged cross-sectional view of the jacket gripping ferrule as installed in the connector of FIG. 1.
Figure 3:
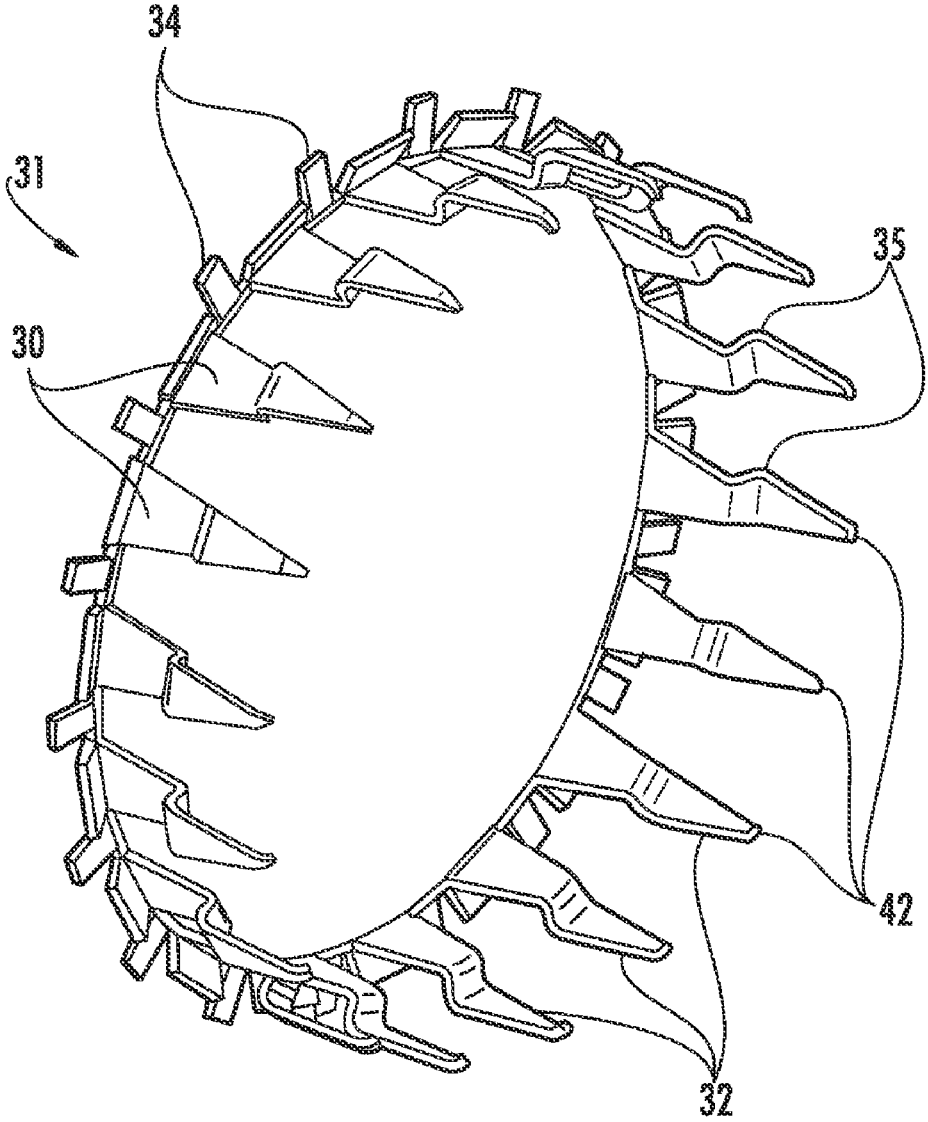
FIG. 3 is a perspective view of the jacket gripping ferrule of FIG. 1.

Referring to FIGS. 1-3, a connector 20 attached to a coaxial cable 45 is now described. The coaxial cable 45 comprises an inner conductor 49, an outer conductor 47, and a dielectric 48 therebetween. The inner conductor 49 is a hollow inner conductor with an inner conductor filament 51, and an inner conductor dielectric 50 therebetween. The outer conductor 47 is illustratively a smooth outer conductor with a flared end, but could be a corrugated outer conductor in other embodiments. The dielectric 48 may be a foam dielectric or other dielectric as known to those skilled in the art.

The end of the coaxial cable 45 is prepared so that the inner conductor 49 extends longitudinally outwardly beyond the end of the outer conductor 47. In addition, portions of the dielectric 48 are removed so that the inner surface of the outer conductor 47 is also exposed. The coaxial cable 45 illustratively includes an outer insulation jacket 46 stripped back a distance so that outer end portions of the outer conductor 47 are exposed. The outer conductor 47 is flared outwardly to define a flared end.

The connector 20 includes an internally threaded back nut 40 to receive an externally threaded rearward end of a connector housing 21. A forward o-ring 24 and a rearward o-ring ring 37 are illustratively provided to seal respective forward and rearward interfaces adjacent the back nut 40 and reduce or prevents moisture ingress.

The back nut 40 is received over the jacket 46 of the coaxial cable 45 and has an internal back nut ramp 41 defined by the inner surface of the back nut 40. A jacket gripping ferrule 31 is within the back nut 40 and comprises a rearward portion 30 configured to be urged radially inwardly by the internal back nut ramp 41 to thereby dig into the cable jacket 46 as the connector housing 21 and back nut 40 are engaged. This advantageously helps to reduce or eliminate axial movement of the connector 20 with respect to the coaxial cable 45. Such movement may interfere with the electrical connections between the coaxial cable 45 and connector 20, causing excess intermodulation distortion.

The jacket gripping ferrule 31 further comprises an intermediate offset defining portion 35 coupled between the rearward portion 30 and a forward portion 30. The connector housing 21 defines a ramp 27 to receive the outer conductor 47 thereagainst. The ramp 27 illustratively has stair-stepped surface, although the skilled artisan will understand that other ramp surfaces may be used. In addition, the back nut 40 illustratively has a spring cavity 29 to receive a ring 28, illustratively an electrically conductive compressible coil spring, defined therein. The ring 28 compressibly clamps against the outer conductor 47 opposite the connector housing ramp 27 as the connector housing 21 and back nut 40 are engaged. The ring 28 illustratively has an axis coaxial with that of the back nut 40.

In addition, the ring 28 engages a radially outwardly extending end 34 of the forward portion 33 of the jacket gripping ferrule 31 as the connector housing 21 and the back nut 40 are engaged. This forces the jacket gripping ferrule 31 to move rearward with respect to the back nut 40, and to be engaged by the back nut ramp 41, which urges the end 42 of the rearward portion 32 downward into the jacket 46.

The back nut 40 has an internal shoulder 30 defined therein. The intermediate offset defining portion 35 of the jacket gripping ferrule 31 is received against the shoulder 30. This prevents excessive axial movement of the jacket gripping ferrule 31 with respect to the back nut 40 prior to engagement between the back nut 40 and connector housing 21.

As best shown in FIG. 3, the forward portion 33 and rearward portion 32 of the jacket gripping ferrule 31 are parallel before the back nut 40 and connector housing 41 are engaged. In some applications, the end 34 of the forward portion 33 is angled rearwardly. As the back nut 40 and connector housing 41 are engaged, the ring 28 engages the end 34 and flattens it against the wall of the ring cavity 29. The rearward angle of the end 34 helps to reduce or prevent movement of the jacket gripping ferrule 31 inside the back nut 40 prior to installation on the coaxial cable 45.

A portion of the connector housing 21 and a portion of the back nut 40 include respective portions 25, 26 defining a positive stop 44 when fully engaged. Indeed, a forward portion 26 of the back nut 40 engages a shoulder 25 of the connector housing 21 to define the positive stop. The forward o-ring 24 is radially inward of and adjacent to the positive stop 44.

The positive stop 44 helps prevent overtightening of the engagement between the connector housing 20 and the back nut 40 that may generate compression and or shearing forces at potentially damaging levels. The positive stop 44 therefore facilitates easy installation of the connector 20 on the coaxial cable 45 by eliminating the need for a torque wrench or other torque limiting tool.

The clamping of the outer conductor 47 against the connector housing ramp 27 by the ring 28 helps to provide an electrical connection between the outer conductor and the connector housing ramp by providing a constant contact pressure therebetween. By maintaining such a secure electrical connection, the intermodulation distortion of signals traveling through the coaxial cable 45 may be reduced.

The ring 28 advantageously maintains a sufficient clamping force on the outer conductor 47 even if the outer conductor changes shape or size due to thermal expansion or aluminum creep, for example, whereas an arrangement of two wedging surfaces to clamp the outer conductor might lose clamping force and contact pressure if the outer conductor were to change shape or size. The ring 28 allows the connector 20 to be used on a variety of coaxial cables with different thicknesses, and on a variety of coaxial cables with outer conductors having different thicknesses.

Furthermore, the clamping provided by the ring 28 reduces radial movement of the connector 20 about the coaxial cable 45. That is, the ring 40 acts as an anti-rotational device, such as a lock washer, to clamp the coaxial cable 45 between the connector housing 21 and back nut 40 and bite into the outer conductor 47 to reduce or prevent rotation of the connector 20 about the coaxial cable 45.

A center contact 43 is supported in the connector housing 21 by the insulator member 22, 23 and is electrically connected to the inner conductor 49. The insulator member 22, 23 is also carries the inner conductor 49 of the cable to reduce or prevent movement to thereby reduce IMD.

The illustrated insulator member 22, 23 is a two piece unit. Of course, the insulator member 22, 23 may also be a monolithically formed one-piece unit in some applications. Such a monolithic construction would help to reduce the number of connector components and thereby reduce the overall cost of the connector 20.

The back nut 40 includes threads 36 to dig into the jacket 46 to securely attach the back nut to the coaxial cable 45. Of course, those skilled in the art will understand that these threads 36 are optional.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A connector to be attached to a coaxial cable comprising an inner conductor, an outer conductor, a dielectric between the inner conductor and outer conductor, and a jacket surrounding the outer conductor, the connector comprising:

a back nut to be received over the jacket of the coaxial cable and having an internal back nut ramp defined therein;

a connector housing to engage said back nut; and a jacket gripping ferrule within said back nut and comprising a rearward portion configured to be urged radially inwardly by the internal back nut ramp to thereby dig into the cable jacket as said connector housing and back nut are engaged.

2. The connector of claim 1, wherein said jacket gripping ferrule comprises a base ring and a plurality of tapered teeth carried thereby.

3. The connector of claim 1, wherein said connector housing has a connector housing ramp defined therein; wherein said jacket gripping ferrule further comprises a forward portion coupled to the rearward portion; and further comprising a ring to clamp against the outer conductor opposite the connector housing ramp and to engage the forward portion of said jacket gripping ferrule as said connector housing and said back nut are engaged.

4. The connector of claim 3, wherein said ring comprises an electrically conductive coil spring.

5. The connector of claim 3, wherein the forward portion of said jacket gripping ferrule has an end extending radially outwardly to be engaged by said ring.

6. The connector of claim 5, wherein the end of the forward portion is angled rearwardly before said connector housing and back nut are fully engaged.

7. The connector of claim 1, wherein the forward portion and rearward portion of said jacket gripping ferrule are parallel before said connector housing and said back nut are fully engaged.

8. The connector of claim 1, wherein said jacket gripping ferrule further comprises an intermediate offset defining portion betWeen the forward portion and the rearward potion.

9. The connector of claim 8, wherein said back nut further has an internal shoulder defined therein; and wherein the intermediate offset defining portion of said jacket gripping ferrule is received against the shoulder.

10. The connector of claim 1, further comprising at least one dielectric body carried within said connector housing and a center contact carried by said at least one dielectric body for coupling to the inner conductor of the coaxial cable.

11. A connector to be attached to a coaxial cable comprising an inner conductor, an outer conductor, a dielectric between the inner conductor and outer conductor, and a jacket surrounding the outer conductor, the connector comprising:

a back nut to be received over the jacket of the coaxial cable and having an internal back nut ramp defined therein;

a connector housing to engage said back nut and having a connector housing ramp defined therein;

a jacket gripping ferrule within said back nut and comprising a rearward portion configured to be urged radially inwardly by the internal back nut ramp to thereby dig into the cable jacket as said connector housing and back nut are engaged, a forward portion coupled to the rearward portion, and an intermediate offset defining portion between the forward portion and the rearward potion; and a ring to clamp against the outer conductor opposite the connector housing ramp and to engage the forward portion of said jacket gripping ferrule as said connector housing and said back nut are engaged.

12. The connector of claim 11, wherein said jacket gripping ferrule comprises a base ring and a plurality of tapered teeth carried thereby.

13. The connector of claim 11, wherein said ring comprises an electrically conductive coil spring.

14. The connector of claim 11, wherein the forward portion of said jacket gripping ferrule has an end extending radially outwardly to be engaged by said ring.

15. The connector of claim 11, wherein the end of the forward portion is angled rearwardly before said housing and back nut are fully engaged.

16. The connector of claim 11, wherein the forward portion and rearward portion of said jacket gripping ferrule are parallel before said connector housing and said back nut are fully engaged.

17. The connector of claim 11, wherein said back nut further has an internal shoulder defined therein; and wherein the intermediate offset defining portion of said jacket gripping ferrule is received against the shoulder.

18. The connector of claim 11, further comprising at least one dielectric body carried within said connector housing and a center contact carried by said at least one dielectric body for coupling to the inner conductor of the coaxial cable.

19. A method of making a connector to be attached to a coaxial cable comprising an inner conductor, an outer conductor, a dielectric between the inner conductor and outer conductor, and a jacket surrounding the outer conductor, the method comprising:

forming a back nut to be received over the jacket of the coaxial cable and having an internal back nut ramp defined therein;

forming a connector housing to engage the back nut;

forming a jacket gripping ferrule to be positioned within the back nut and comprising a rearward portion configured to be urged radially inwardly by the internal back nut ramp to thereby dig into the cable jacket as the connector housing and back nut are engaged.

20. The method of claim 19, wherein the jacket gripping ferrule is formed to have a base ring and a plurality of tapered teeth carried thereby.

21. The method of claim 19, wherein the connector housing is formed to have a connector housing ramp defined therein; wherein the jacket gripping ferrule is also formed to have a forward portion coupled to the rearward portion; and further comprising positioning a ring to clamp against the outer conductor opposite the connector housing ramp and to engage the forward portion of the jacket gripping ferrule as the connector housing and the back nut are engaged.

22. The method of claim 21, wherein the ring comprises an electrically conductive coil spring.

23. The method of claim 21, wherein the jacket gripping ferrule is also formed to have an end of the forward portion that extends radially outwardly to be engaged by the ring.

24. The method of claim 16, wherein the end of the forward portion is angled rearwardly before the connector housing and the back nut are fully engaged.

25. The method of claim 19, wherein the forward portion and rearward portions of the jacket gripping ferrule are formed to be parallel before the connector housing and the back nut are fully engaged.

26. The method of claim 19, wherein the jacket gripping ferrule is also formed to have an intermediate offset defining portion between the forward portion and the rearward potion.

27. The method of claim 26, wherein the back nut is also formed to have an internal shoulder defined therein; and wherein the intermediate offset defining portion of the jacket gripping ferrule is received against the shoulder.

* * * * *

UNITED STATES PATENT AND TRADEMARK OFFICE

CERTIFICATE OF CORRECTION

PATENT NO. : 7,857,661 B1
APPLICATION NO. : 12/706162
DATED : December 28, 2010
INVENTOR(S) : Islam It is certified that error appears in the above-identified patent and that said Letters Patent is hereby corrected as shown below:

IN THE SPECIFICATIONS:

| | |
|---|---|
| Column 4, Line 3 | Delete: "has stair-stepped"<br>Insert --has a stair-stepped-- |
| Column 5, Line 11 | Delete: "is also"<br>Insert: --also-- |

IN THE CLAIMS:

| | |
|---|---|
| Column 6, Line 3, Claim 8, | Delete: "betWeen"<br>Insert: --between-- |

Signed and Sealed this
Fifth Day of July, 2011

David J. Kappos

David J. Kappos
*Director of the United States Patent and Trademark Office*